US005540642A

United States Patent [19]

Sprague

[11] Patent Number: 5,540,642

[45] **Date of Patent: *Jul. 30, 1996**

[54] AEROBIC EXERCISE DEVICE

[76] Inventor: Edwin J. Sprague, 2146 Valley View Dr., Folcroft, Pa. 19032

[ * ] Notice: The term of this patent shall not extend beyond the expiration date of Pat. No. Des. 353,419.

[21] Appl. No.: 105,138

[22] Filed: Aug. 12, 1993

[51] Int. Cl.[6] ..... A63B 21/02

[52] U.S. Cl. ..... 482/123; 482/52; 482/133; 482/142; D21/191

[58] Field of Search ..... 482/52, 74, 121, 482/122, 123, 127, 129, 130, 133, 140, 141, 142, 907; 108/38, 40, 144; D21/191, 192, 193, 195; D6/422, 423, 426, 437, 441; 297/423.1, 452.23, 452.24

[56] References Cited

U.S. PATENT DOCUMENTS

| | | | |
|---|---|---|---|
| 189,356 | 4/1877 | Hanson et al. | 482/130 |
| D. 353,419 | 12/1994 | Sprague | D21/191 |
| 2,512,911 | 6/1950 | Benice | 482/127 |
| 4,478,413 | 10/1984 | Siwula | 482/123 |
| 4,645,204 | 2/1987 | Berger | 482/123 |
| 4,863,163 | 9/1989 | Wehrell | 482/123 |
| 4,944,511 | 7/1990 | Francis | 482/123 |
| 5,076,579 | 12/1991 | Rickey | 482/52 |
| 5,226,867 | 7/1993 | Beal | 482/127 |

FOREIGN PATENT DOCUMENTS

| | | | |
|---|---|---|---|
| 507509 | 10/1992 | European Pat. Off. | 482/123 |
| 3011832 | 6/1993 | WIPO | 482/130 |

*Primary Examiner*—Richard J. Apley
*Assistant Examiner*—Jeanne M. Clark
*Attorney, Agent, or Firm*—Connolly & Hutz

[57] ABSTRACT

An aerobic exercise device includes a central portion having a flat upper surface which comprises a central aerobic exercise platform. A wing section is connected to and is offset from the central portion on each side thereof. Each wing section has a flat upper surface to provide an auxiliary aerobic exercise platform. The upper surface of the wing sections is co-planar with the upper surface of the central portion so that a continuous aerobic exercise platform is formed.

22 Claims, 9 Drawing Sheets

AEROBIC EXERCISE DEVICE

BACKGROUND OF THE INVENTION

Various types of aerobic exercise devices exist for developing different muscles. One form of device includes the use of adjustable steps to provide the user with the ability to alter the height of the exercise platform in accordance with the user's particular needs. Other types of aerobic exercises are also known including, for example, treadmills, steppers and stairmasters.

It would be desirable to provide a device which is inexpensive and easy to use, yet which permits the development of, for example, the chest, arms, back, shoulders, legs, abdominal and aerobic training in a simple and easy manner so as to enhance cardiovascular and strength gains. It would also be desirable to provide such a device which could be conveniently stored during periods of non-use by sliding the device under a bed or sofa.

It would further be desirable if such a device could be provided which permits different types of exercises taking place while the user is off the device but the user pulls cords on the device to enhance the exercises. It would further be desirable if such devices could also be used by persons having physical impairments such as being confined to wheelchairs.

SUMMARY OF THE INVENTION

An object of this invention is to provide an aerobic exercise device and method of use thereof which fulfills the above needs and desires.

A further object of this invention is to provide such a device and method of use thereof which has a wide range of versatility while having the capacity of a full body workout.

A still further object of this invention is to provide such a device which permits the moving from exercise to exercise and resistance load changing in a quick and simple fashion.

In accordance with this invention an aerobic exercise device in its broadest form includes a central portion having a flat upper surface to comprise a central aerobic exercise platform. At least one wing section is connected to and offset from the central portion. The wing section also has a flat upper surface to provide an auxiliary exercise platform. The upper surfaces of the wing section and central portion are coplanar so as to provide a continuous aerobic exercise platform.

In the preferred practice of this invention a wing section extends from each side of the central portion with the wing sections being mirror images of each other so as to provide a concave peripheral edge along one side of the device which creates an area which may be used in certain of the exercises. A pull cord is preferably provided at each wing section near the central portion with the pull cord having adjustable resistance. The device itself is weighted by preferably having compartments into which weights, such as sand or metal bars may be removably inserted. The weights provide stability for the device which permits the use of other exercises performed by pushing against the device.

THE DRAWINGS

Figure 7:
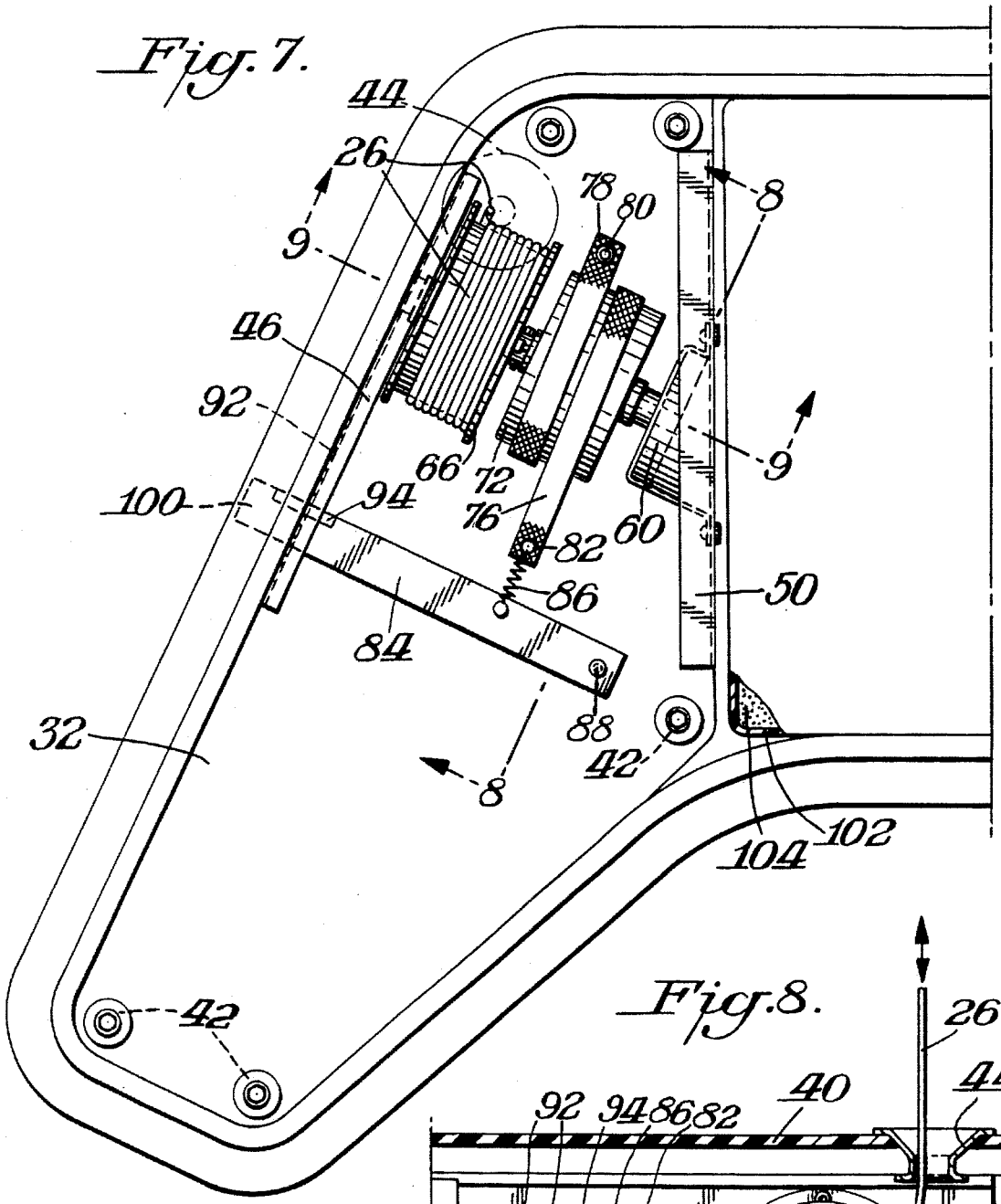
FIG. 7 is a top plan view of the left hand portion of the exercise device shown in FIGS. 1–2 with the deck removed, the right hand portion being a mirror image thereof.
Figure 8:
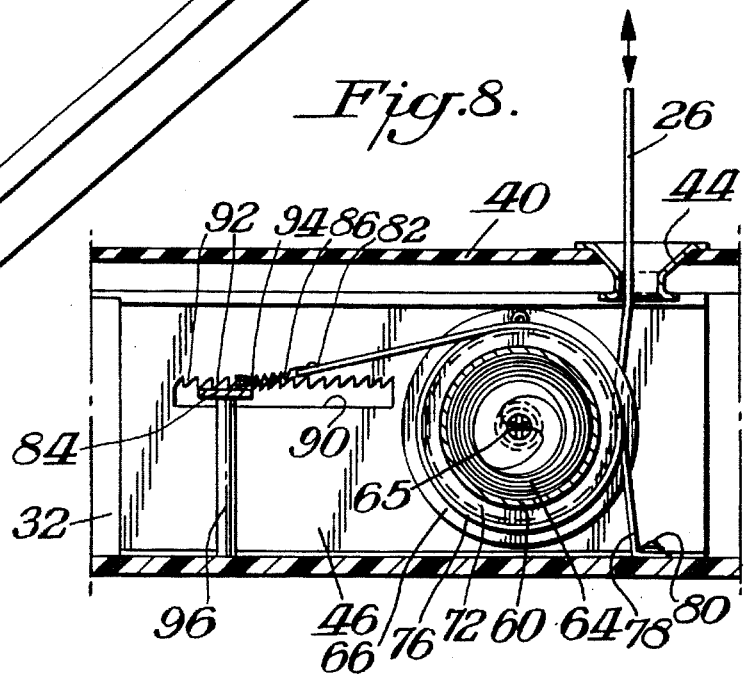
Figure 9:
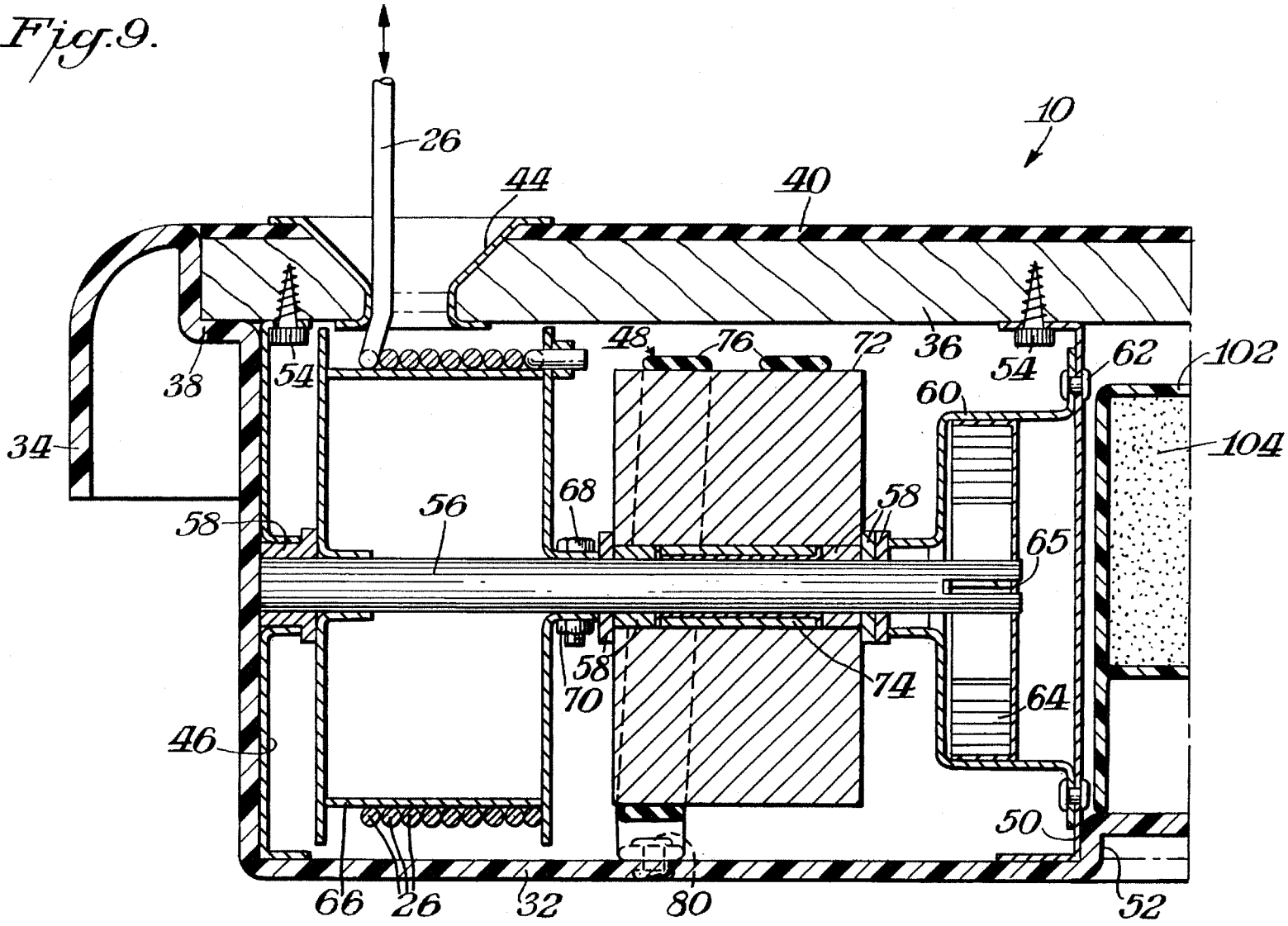
Figure 10:
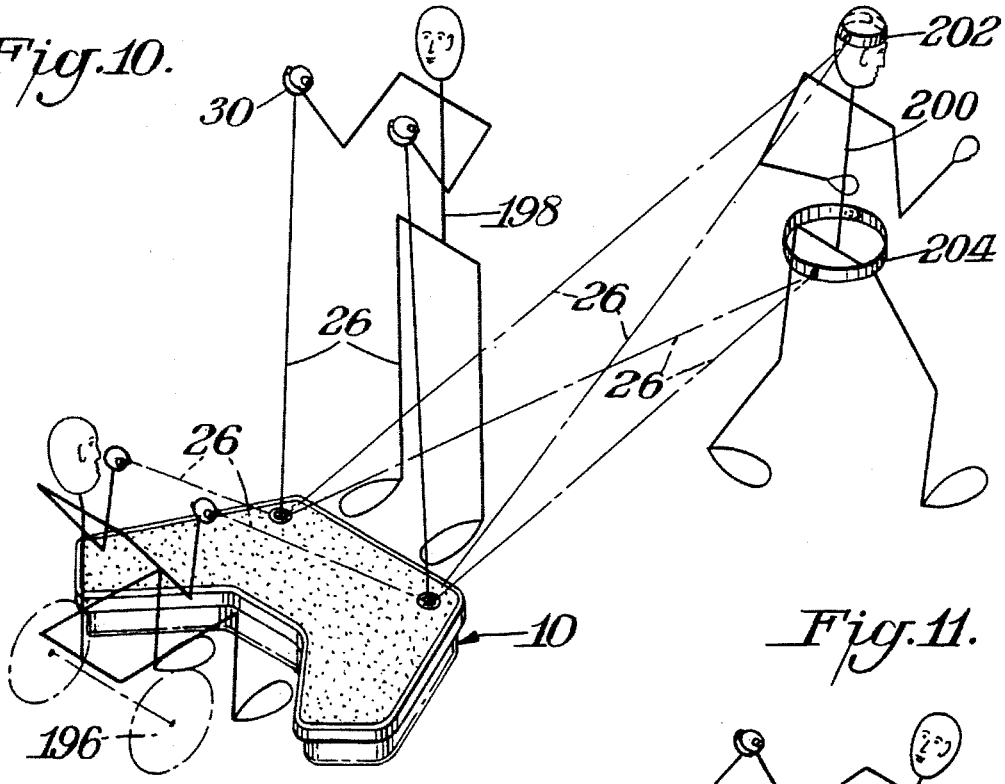
Figure 11:
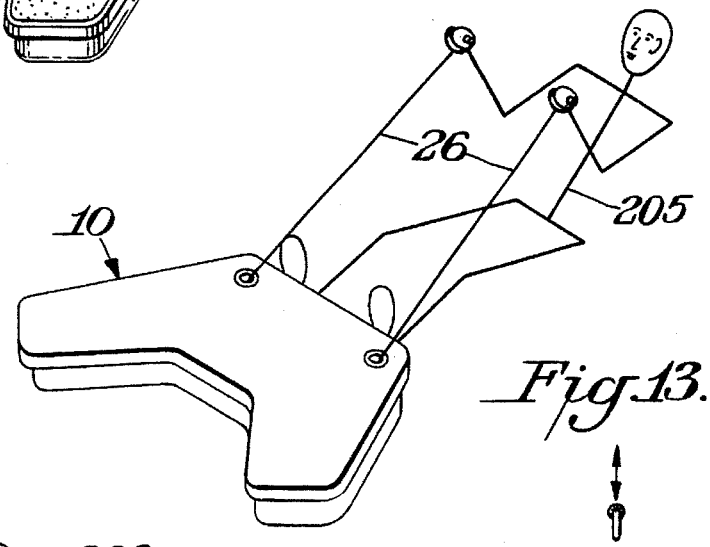
Figure 12:
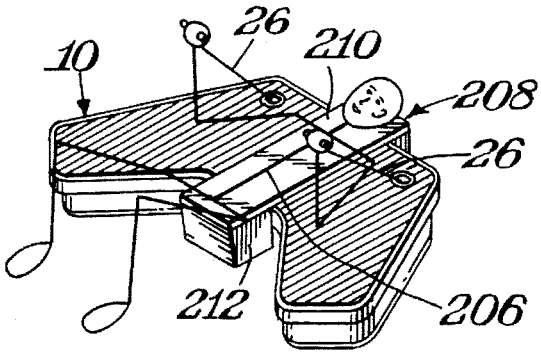
Figure 13:
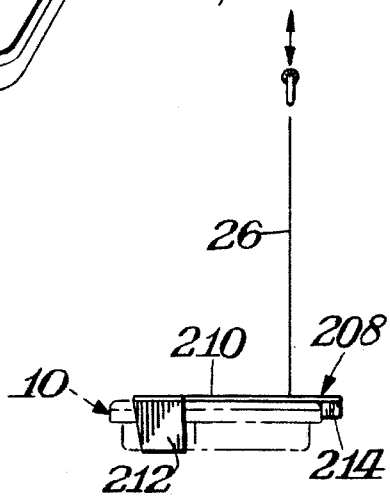
Figure 15:
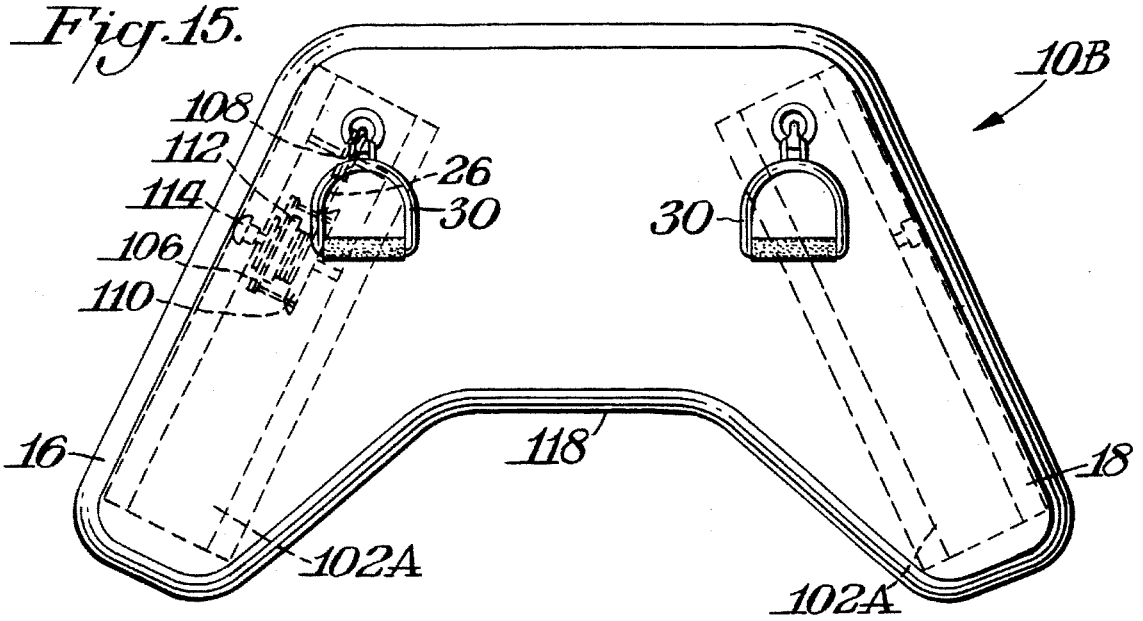
Figure 14:
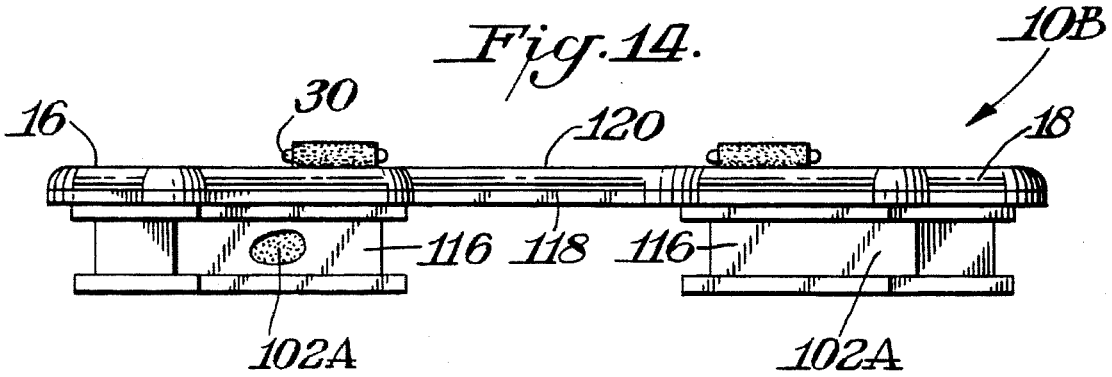
Figure 16:
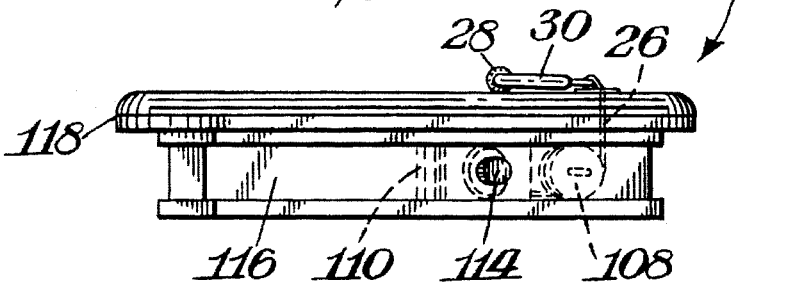
Figure 17:
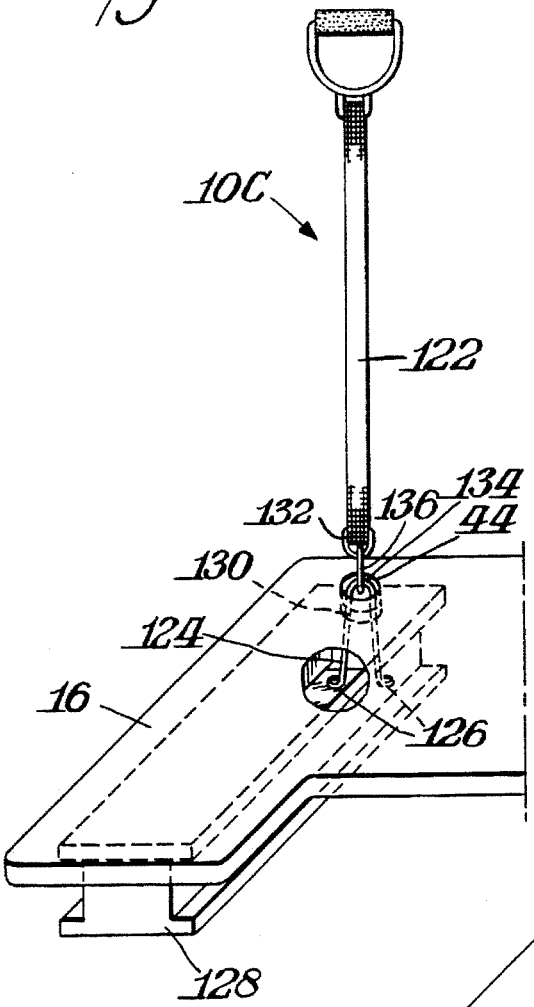
Figure 18:
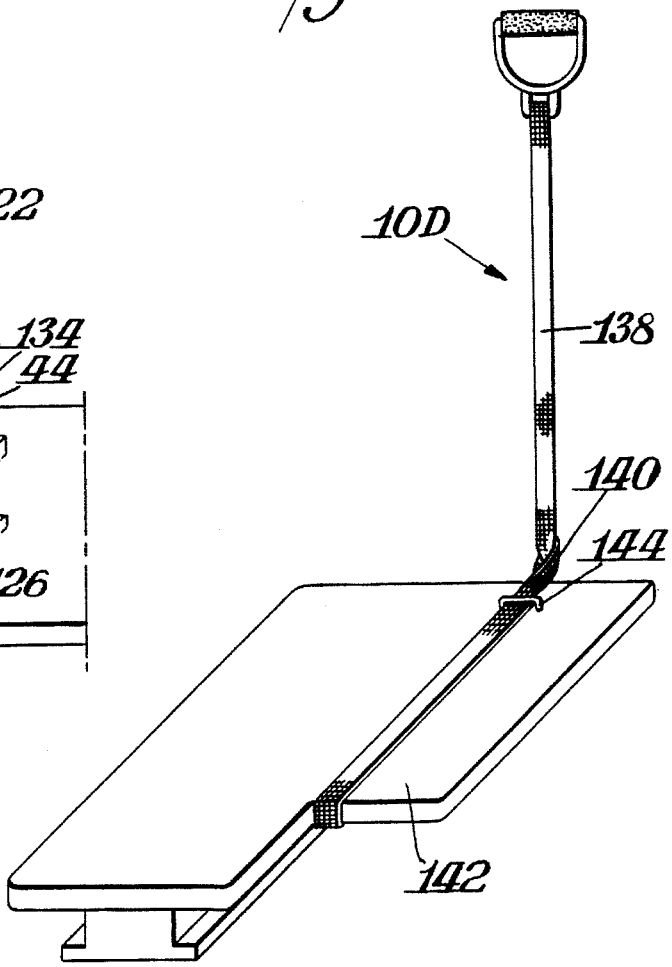
Figure 19:
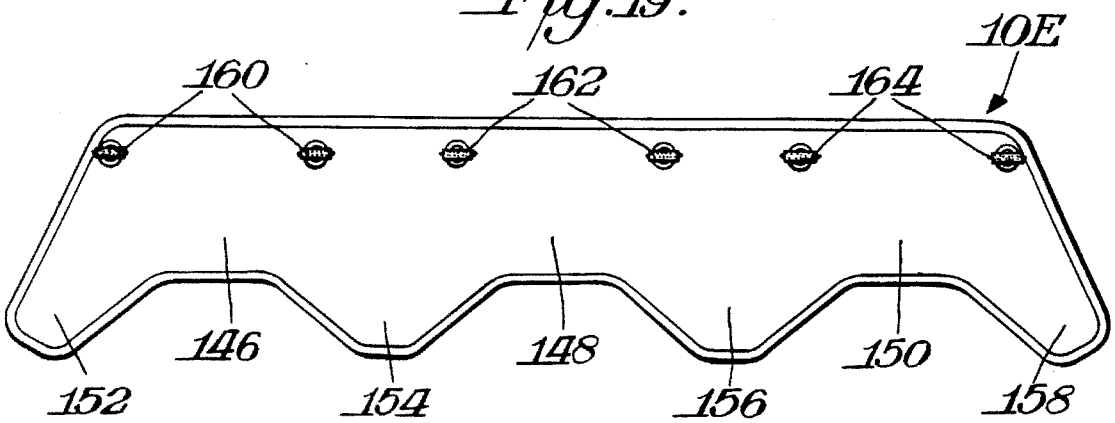
Figure 20:
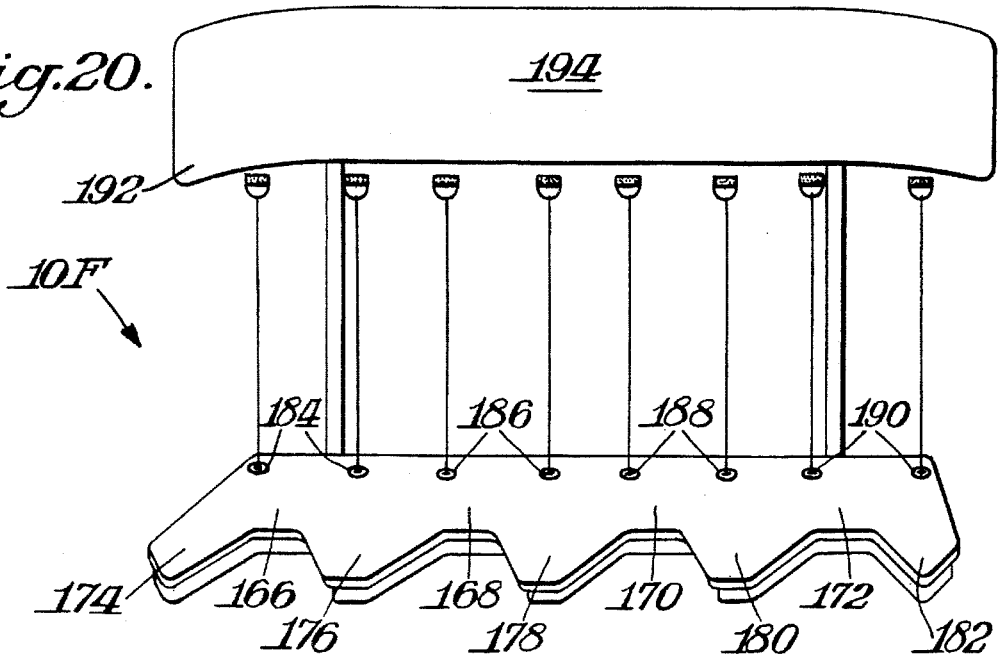

FIGS. 8 and 9 are cross-sectional views taken through FIG. 7 along the lines 8—8 and 9—9, respectively;

FIG. 10 is a perspective view schematically illustrating various types of exercises that could be performed with the exercise device of FIGS. 1–5 and 7–9;

FIG. 11 is a view similar to FIG. 10 showing another form of exercise in accordance with this invention;

FIG. 12 is a pictorial view of the exercise device of FIGS. 1–5 and 7–9 having a backboard removably attached thereto;

FIG. 13 is a side elevational view of the device shown in FIG. 12;

FIG. 14 is a front elevational view of an alternative form of aerobic exercise device in accordance with this invention;

FIG. 15 is a top plan view of the device shown in FIG. 14;

FIG. 16 is a right side elevational view of the device shown in FIGS. 14–15;

FIGS. 17–18 are pictorial views of portions of other devices in accordance with this invention; and FIGS. 19–20 are pictorial views of still yet further devices in accordance with this invention.

DETAILED DESCRIPTION

FIGS. 1–5 illustrate an aerobic exercise device 10 in accordance with one embodiment of this invention. As shown therein device 10 includes a central portion 12 having a flat upper surface which comprises a central aerobic exercise platform 14. A wing section 16, 18 is connected to and offset from each side of the central portion 12. Each wing section 16, 18 has a flat upper surface 20 which is co-planar with the central upper surface 14 to form a continuous aerobic exercise platform. The diverging mirror image wing sections result in a concave peripheral portion 22 having an open area 24 in which a user may stand, step, be seated or lay in accordance with various exercises.

In the preferred practice of the invention a pull cords 26 extend from each wing section 16, 18 near the junction with the central portion 12. Each pull cord 26 terminates in a handle 28 of any suitable construction. As illustrated the handles include foam cylinders around a central shaft which spans a U member 30 connected to each cord 26 in a known manner.

In the broad practice of the invention only a single wing section may be connected to the central portion. It is preferred, however, to utilize a pair of wings since this adds to the versatility of device 10.

Figure 6:
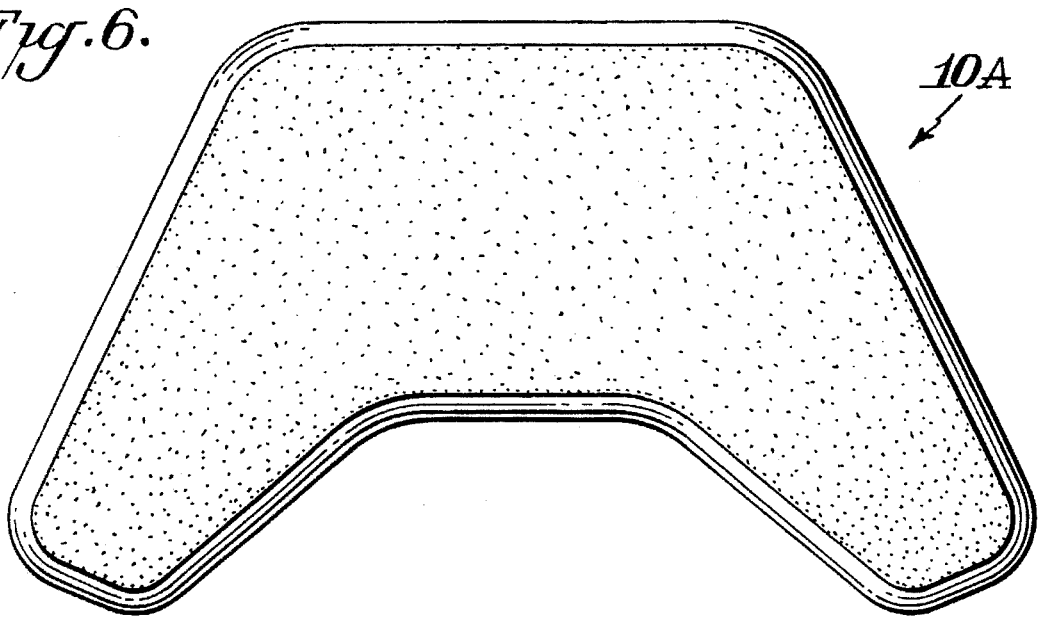
FIG. 6 is a top plan view of a modified form of exercise device in accordance with another embodiment of this invention.

FIG. 6 also illustrates a broad practice of the invention wherein device 10A is generally identical to device 10 except that it does not include cords 26.

In the preferred practice of the invention the cords 26 provide adjustable resistance to the user so as to develop various arm and shoulder muscles. FIGS. 7–9 illustrate the details of providing this adjustable resistance as well as details in the general construction of device 10.

As shown in FIGS. 7–9 and in particular in FIG. 9, device 10 includes a housing 32 which may be made of any suitable material such as high density polyethylene. Housing 32 terminates in a downwardly turned lip 34. A deck 36 is detachably mounted on a peripheral shoulder 38 of housing 32. A mat 40 covers the upper surface of deck 36. Mat 40 is preferably made of a non-slip material such as vinyl or rubber. Deck 36 may be made of any suitable material such as plywood or plastic.

A plurality of glide feet 42 (FIGS. 1 and 7) made from any suitable material such as rubber is mounted at spaced locations in the bottom of housing 32.

Deck 36 includes a generally conically shaped guide insert or opening 44 through which cords 26 would extend. The tapered or conical opening is particularly advantageous since it permits cord 26 to be moved in any direction and avoids any contact with a sharp edge when the cord is bent. Guide 44 may be made of any suitable material such as a stamped metal.

An outer bracket 46 is mounted at the inner side of housing 32 for supporting the tension adjusting mechanism 48 for cord 26. Similarly, an inner bracket 50 is provided within housing 32 against shoulder 52. Inner bracket 50 cooperates with outer bracket 46 in supporting the tension adjusting mechanism 48. Each bracket 46,50 has lower horizontal extensions which rest on the base of housing 32.

Deck 36 is mounted to horizontal extensions of brackets 46,50 in any suitable manner such as by screws 54. As a result if it is desired to obtain access to the tension adjusting mechanism 48, deck 36 could be removed by lifting upwardly to remove the brackets 46 and 50 and also the tension adjusting mechanism 48 attached to the bracket. The cord guides 44 may provide convenient access for gripping deck 36 when it is desired to remove the deck.

FIGS. 7–9 best illustrate the details of tension adjusting mechanism 48. As shown therein a shaft 56 is mounted at one end to bracket 46 for rotation in suitable bushings 58. The inner end of shaft 56 is secured to inner bracket 50 by being mounted to spring holder 60 which in turn is secured to bracket 50 by rivets 62 or any other suitable fasteners. A helical spring 64 is mounted within spring holder 60. The end of spring 64 is inserted into the spring retainer slit 65 of shaft 56 so as to cause shaft 56 to rotate in a return direction for pulling cord 26 back into housing 32 as later described.

Cord 26 is mounted on drum 66 which in turn is secured to shaft 56 in any suitable manner such as by bolt 68 and nut 70. Accordingly, drum 66 rotates along with shaft 56. As illustrated a tensioning drum 72 is mounted on shaft 56 between cord drum 66 and spring holder 60. Tensioning drum 62 is mounted to shaft 56 by being disposed on clutch roller 74. A tensioning strap 76 is mounted around drum 72. As shown in FIG. 7 one end 78 of strap 76 is anchored in any suitable manner by fastener 80. The other end 82 of strap 76 is connected to tension arm 84 by spring 86. Tension arm 84, in turn, is pivoted about pin 88 for movement toward and away from drum 72.

Strap 76 may be made of any suitable material such as a synthetic blend to provide a sufficient strength to perform its intended function. Tension arm 84 may be made of any suitable material such as metal stock.

As shown in FIGS. 7–8 a ratchet 90 having ratchet teeth 92 is secured at the inner surface of outer bracket 46 of housing 32. Tension arm 84 includes a pawl 94 which is selectively engaged with a tooth 92 of ratchet 90. As also illustrated in FIG. 8 a bracket support post 96 is provided at outer bracket 46.

Figure 2:
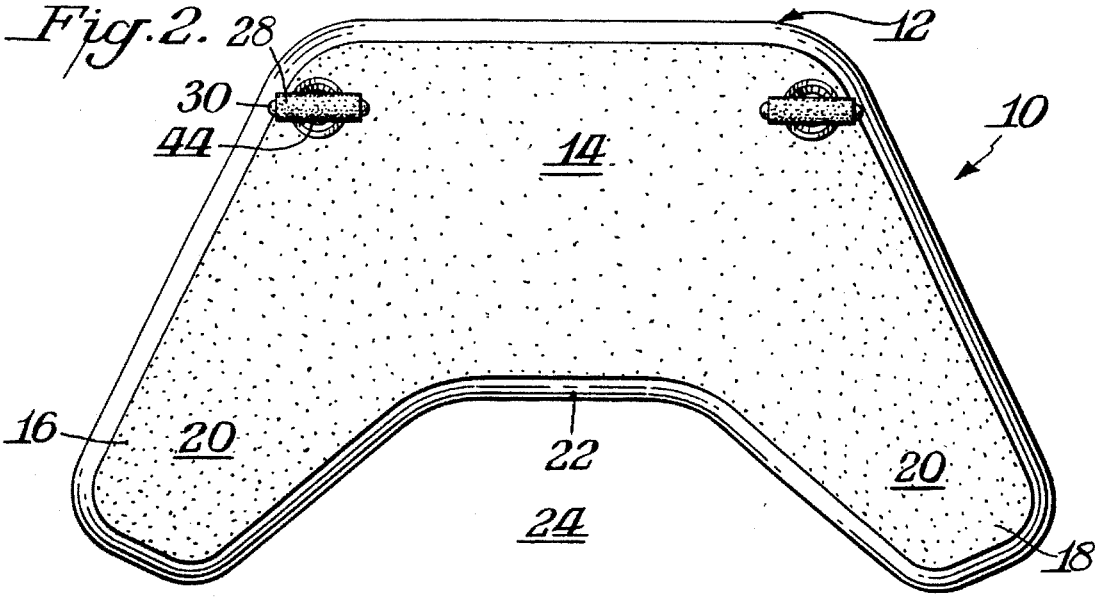
FIG. 2 is a top plan view of the device shown in FIG. 1.
Figure 1:
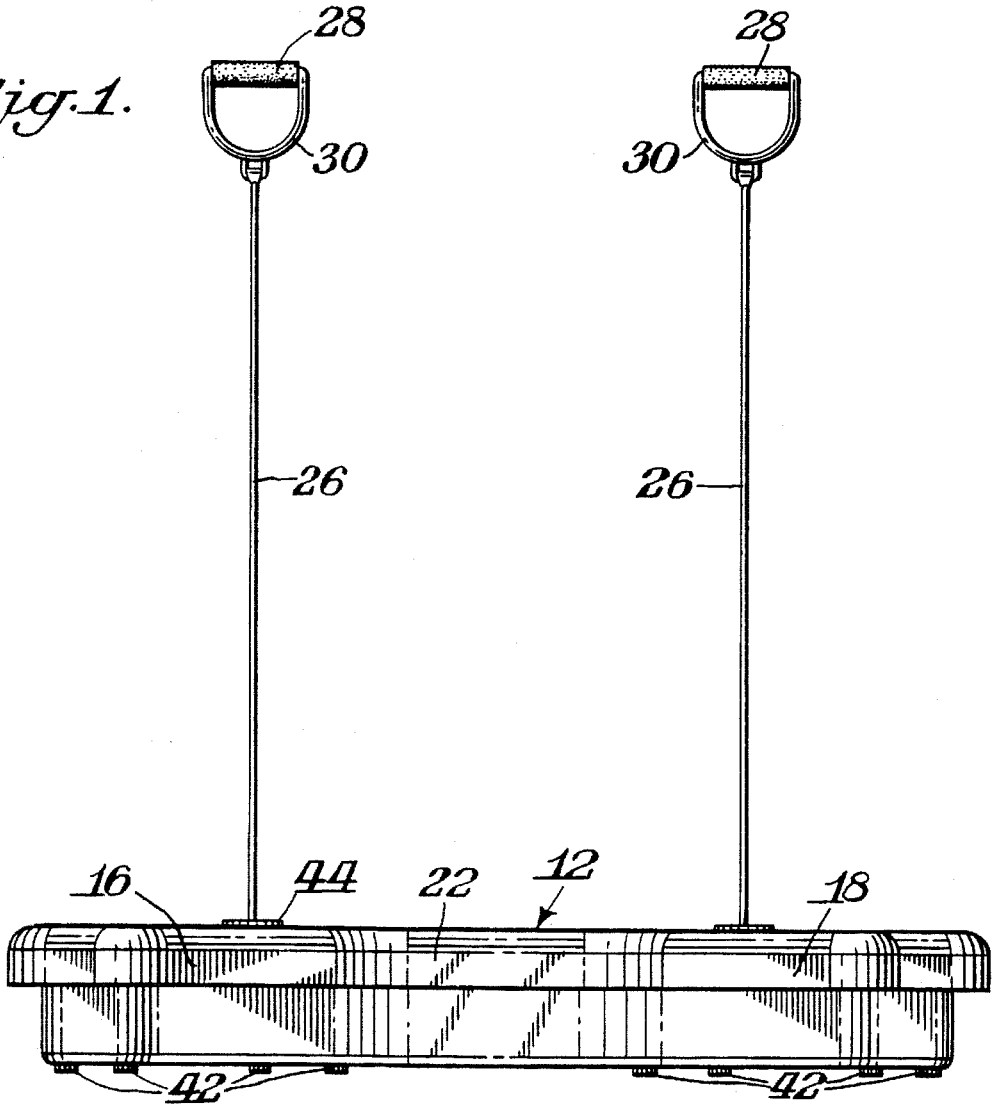
FIG. 1 is a front elevational view of an aerobic exercise device in accordance with this invention.
Figure 3:
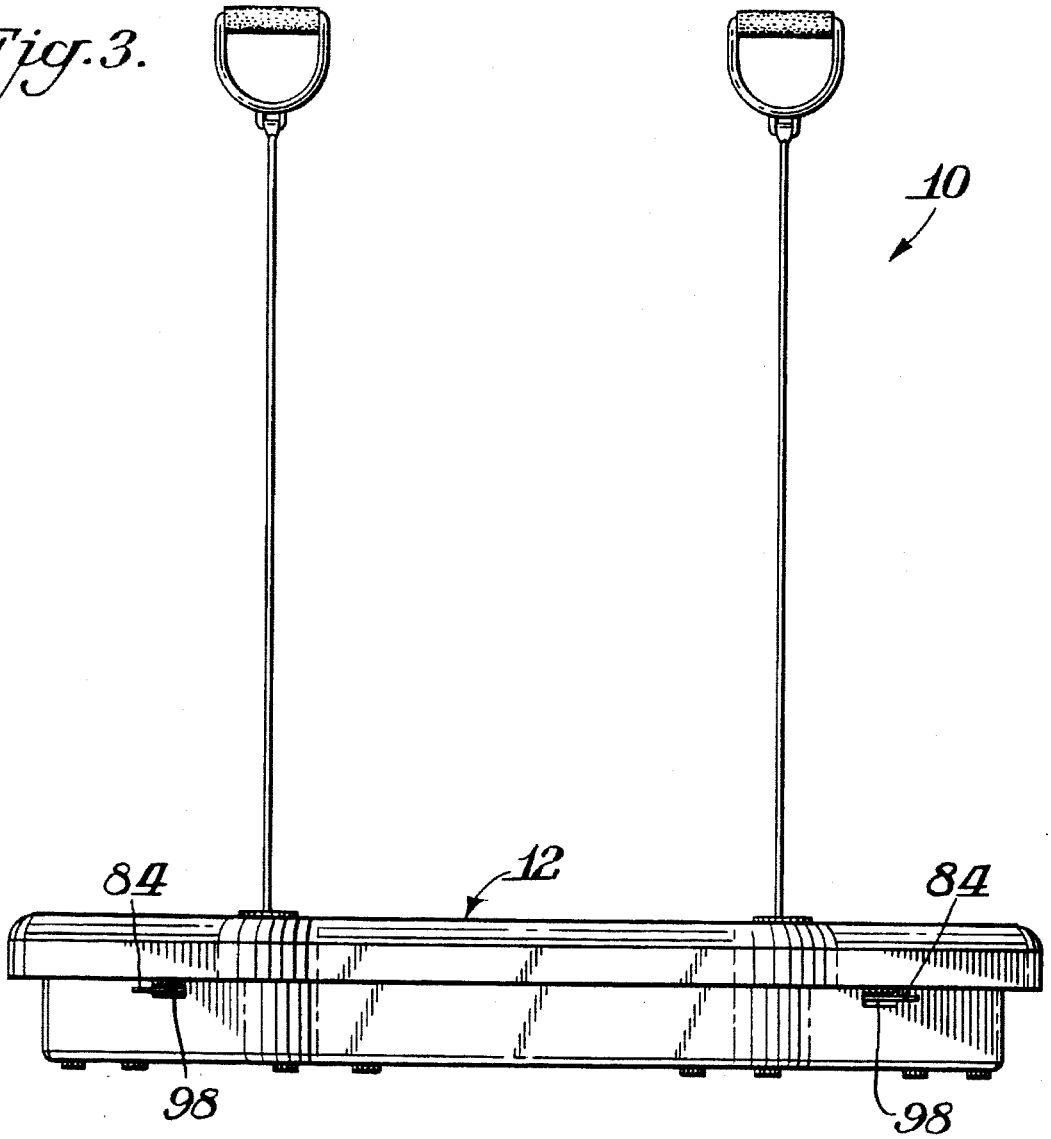
FIG. 3 is a rear elevational view of the device shown in FIGS. 1–2.
Figure 4:
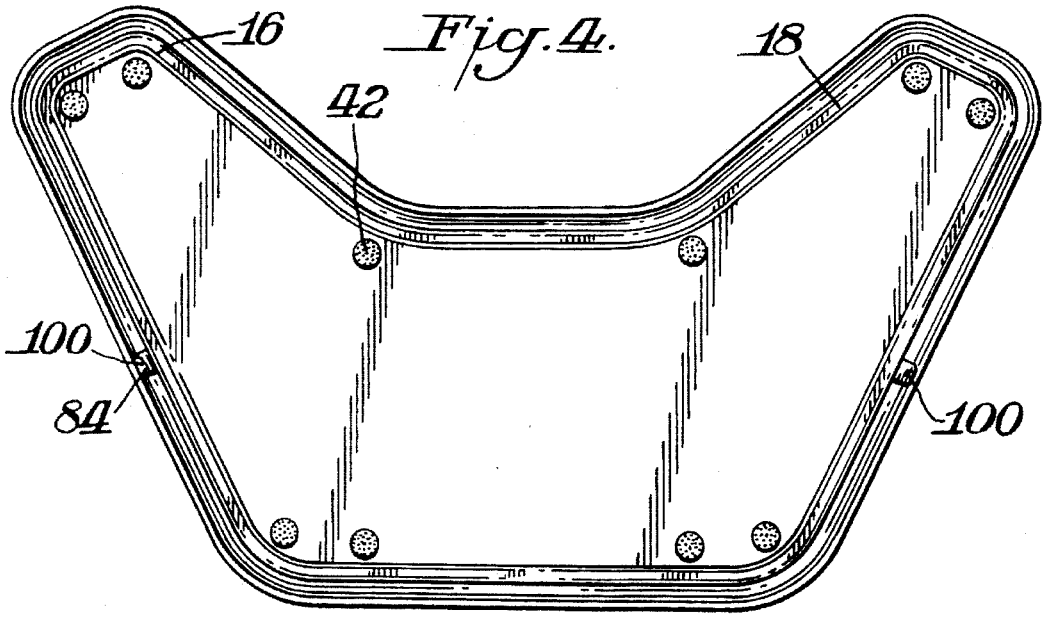
FIG. 4 is a bottom plan view of the device shown in FIGS. 1–3.
Figure 5:
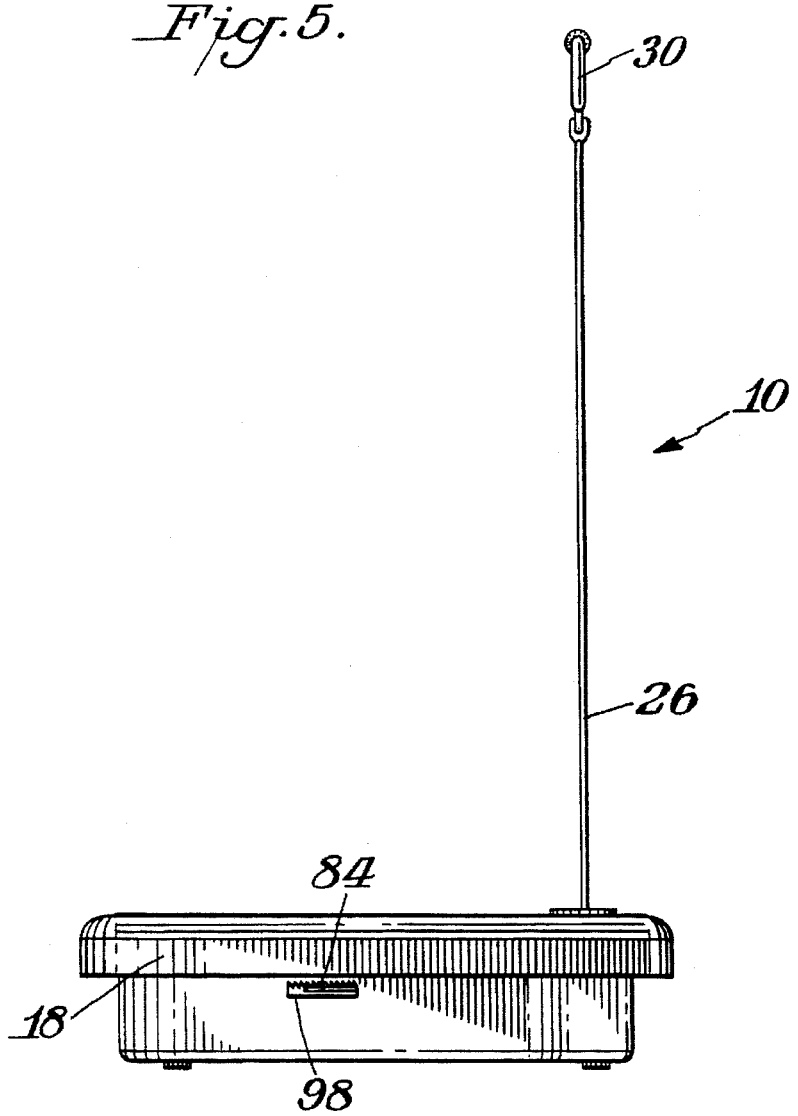
FIG. 5 is a side elevational view of the device shown in FIGS. 1–4.

As best shown in FIGS. 3 and 5 an elongated slot 98 is provided in housing 32 so that the outer end 100 (FIG. 7) of tension arm 84 can extend through housing 32 and be accessible from the exterior of housing 32. Thus, the tension may be adjusted by lifting end 100 so that the pawl 94 is disengaged from ratchet 90. Tension arm 84 may then be pivoted toward or away from drum 72 by sliding outer end 100 and then releasing the outer end 100 to again reengage pawl 94 with a tooth 92 on ratchet 90. If pawl 94 is moved toward the right as shown in FIG. 8 there is less tension. If pawl 94 is moved to the left there is greater tension. The tension from strap 76 on drum 72 is transmitted to shaft 56 which in turn is transmitted to cord 26 to resist the outward pulling by the user on cord 26. The cord is then urged to its return direction by helical spring 64.

A further feature of device 10 is the provision of compartments 102 at any suitable location such as in central portion 12. Compartments 102 would receive weights which add to the stability of device 10. This is particularly desirable during the exercises when the user applies a force against the sides of device 10. The weights may take any suitable form such as sand 104. Alternatively, the weights could be metal bars or any other types of weights. Advantageously, some or all of the weights could be removed should it be desired to lessen the overall weight of device 10. Thus, for example, if the user does not intend to perform any exercise which requires a great amount of stability, some or all of the weights could be removed thereby making device 10 easier to slide under a sofa or bed.

FIGS. 14–15 illustrate a variation of the invention wherein compartments 102A are provided in the wings 16,18 for containing the sand or other weights. It is to be understood that if the user intends to use device 10 solely as a platform then it is not necessary to include any compartments for weights.

FIGS. 14–16 illustrate a modified form of providing tension to cords 26. As shown therein a torque reel 106 is mounted within each wing 16,18. A pulley 108 is provided for cord 26. Reel 106 is secured to mounting plate 110. A spring coil 112 is utilized for applying the tension to reel 106 and thereby control the resistance offered to the outward pulling of cord 26. The tension could be adjusted by means of torque adjustment knob 114 which is accessible from the outside of device 10B as best shown in FIG. 16. The sand compartment 102A could be provided in the bottom of the base 116 for wing sections 16,20. As is best shown in FIG. 14 device 10B differs in structure from device 10 in that a more simplified housing 118 is used for supporting deck 120 with the base 116 for each wing providing the necessary elevation.

FIG. 17 illustrates an alternative manner of mounting the cords to device 10C. As shown therein the cord 122 is a bungi type cord which has elastic qualities whereas cords 26 may be non-elastic. Adjustable resistance may be achieved by detachably mounting the bungi cord 122 so that different resistances could be obtained by use of different cords. If desired, a color coding could be used to correspond to the different resistances. Similarly, the readily detachable mounting also provides for the use of different length cords ranging, for example, from 6 inches to 24 inches.

As shown in FIG. 17 the detachable mounting of bungi cord 122 is achieved by providing a hook assembly 124 through guide opening 44. Hook assembly 144 would be anchored by suitable fasteners 126 within base 128 of its corresponding wing section 16,18. A stabilizer, such as rubber band 130, is mounted around the upper portion of hook 124 to maintain the hook assembly 124 in a tight or closed condition. Cord 122 terminates in a loop 132 which is detachably connected to the loop end 134 of hook assembly 124. Any suitable means of attachment may be used such as a clip or hook fastener 136 to connect the cord 122 to hook assembly 124. The upper end 134 of hook assembly 124 is preferably flush with the deck surface thus leaving room for slight movement for shock as well as access to the hook assembly for securing the bungi cord 122. In this embodiment it is not necessary to have the deck opening 44 of conical shape since the mounting of cord 122 is located generally at the upper surface of the deck. Thus complete pivotal movement of cord 122 is possible by having the pivotal movement take place at or above the deck surface. Stabilizer band 130 functions to thicken the hook assembly at the point which the hook assembly settles in the deck hole 44. This prevents the assembly from having excessive motion. Such a stabilizer is not necessary if the clearance for hook assembly 124 with respect to deck hole 44 is sufficiently close and if the hole has a rubber shock system built in.

As an alternative to using a separate fastener 136 it is possible to provide the upper end 134 of hook assembly 124 with a downwardly extending latch or projection which in turn forms a hook onto which loop 132 may be mounted.

FIG. 18 illustrates yet another form of mounting a cord 138. As shown therein one end of cord 138 would have a loop 140. The cord 138 could be wrapped around the deck 142 of device 10D and then inserted through the loop 140 and pulled upwardly. This eliminates the need for a deck hole such as used in FIG. 17. The cord 138 would provide its own resistance by being a bungi cord which could be easily detached to vary the resistance. If desired, a guide member 144 such as an inverted U fastener may be detached to deck 142 to assure that cord 138 is properly positioned on deck 142.

The various embodiments described herein pertain to devices which utilize a central portion and a pair of wings. As previously discussed it is possible to broadly practice the invention with only a single wing. The invention may also be practiced with three or more wings. FIGS. 19–20 illustrate other practices of the invention wherein more than two wings may be used.

FIG. 19 illustrates a device 10E which includes three central sections 146, 148, 150 with a plurality of wings 152, 154, 156 and 158. This device may be used by one or more persons. Thus separate sets of pull cords 160, 162 and 164 would be provided for the pair of wings of each central portion for simultaneous use by as much as three individuals.

FIG. 20 illustrates a variation of FIG. 19 wherein device 10F includes four central portions 166, 168, 170 and 172, provided with wings 174, 176, 178, 180 and 182. Sets of cords 184, 186, 188 and 190 are provided for each central portion and its pair of wings. FIG. 20 illustrates other possible variations of the invention wherein the device 10F may be provided with a surround sound system 192 and may include a screen 194 for use with a video instruction tape. Any conventional surround sound and video screen may be utilized in this embodiment.

It is also to be understood that any of the specific details described with one embodiment may be used with other embodiments.

Various devices may be used wherein the deck or platform functions as an aerobic platform in a known manner. The provision of outwardly off-set wings from the central portion enhances such aerobic platforms by providing additional areas on which the user may step.

FIGS. 10–13 illustrate other uses of the invention which would involve exercises wherein the device is not used as an aerobic platform. FIG. 10, for example, illustrates how a user confined to a wheelchair 196 could move the wheelchair into the concave area formed between the wings and the central portion and by sitting in the wheelchair exercise by pulling the cords.

FIG. 10 also illustrates how an individual 198 could stand at the opposite edge of the device near the central portion and perform a pull exercise from this standing position.

FIG. 10 further illustrates how the invention may be used where the user 200 is located remote from device 10. User 200 may grasp the handles 28 of the cords or may otherwise have the cords attached to the user such as by a head harness 202 or a waist belt 204. Although not illustrated the cords may be attached to the user's ankles. Where sufficiently long cords are used the user could perform a running exercise by starting at the edge of device 10 and then run in a direction away from device 10 in opposition to the resistance provided by cords 26.

FIG. 11 illustrates a use of the invention wherein the user 205 lays on the floor in a prone position near device 10 and uses device 10 as a support for performing such exercises as situps or knee bends.

FIGS. 12–13 illustrate yet another practice of the invention where device 10 is used as a bench. In this practice of the invention it is preferable to detachably mount a backboard 208 over device 10. Backboard 208 includes a horizontal surface 210. A mounting block 212 is provided under one end of horizontal surface 210 for being located in the concave area between the wings. The opposite end of horizontal end 210 has a smaller block 214 for fitting over the opposite edge of the central portion to prevent the backboard 208 from being dislodged.

As best illustrated in FIG. 13 block 212 is dimensioned to contact the floor, while block 214 is of lesser dimension to act as a stop member. Backboard 208 may thus be nested over device 10 without any positive anchoring other than resulting from the blocks 212 and 214. If desired, any suitable means, however, may be utilized to physically attach the backboard 208 to device 10.

FIG. 12 illustrates use of the backboard 208 for performing various bench press exercises or other exercises which would involve the user 206 being in a lying rather than in a standing or sitting position.

As should be apparent, the various devices of this invention provide a full range of motion that is utilized through the cable power system. In the preferred practices, the invention offers resistance training from every conceivable angle and range of motion. The invention utilizes the body's natural axis of power and balance by employing a system that mimics normal human motion. This is done by placing the power system at shoulder width at the base of the body and at the feet, with the device offering superb strength and support training qualities. No equipment change is needed to perform the various exercises. Accessories such as a backboard or bungi cords could be used, each of which is easily mounted within seconds.

What is claimed is:

1. An aerobic exercise device comprising a base having a lower end and an upper end connected together by an upstanding side wall, said lower end having a planar floor contacting surface, said base having a central portion with a substantially rigid flat upper surface to comprise a central aerobic exercise platform, said base having a wing section mounted to and offset from said central portion on each side of said central portion to thereby result in two wing sections and an intermediate central portion which together generally form a U shape in plan view, each of said wing sections having a substantially rigid flat upper surface to provide an auxiliary aerobic exercise platform coplanar with and joined to said central aerobic platform to provide a continuous aerobic exercise platform, said continuous aerobic exercise platform being substantially parallel to and elevated above said floor contact surface to thereby provide three connected non-aligned stepping surfaces, a generally concave open area being within the periphery of the connecting upper edge of said wing sections and said central portion to permit the user to selectively step to and from the floor and to and from said stepping surfaces in a variety of directions and sequences, said wing sections extending away from said central portion a sufficient distance and being of sufficient size and spacing to comprise multiple function means for providing stability to said device during use and for functioning as a locator to permit a chair to be placed in said open area and as a stop to limit the movement of the chair and as a locator for permitting a bench to be placed over said central portion and extend into said open area between said wing sections and as a stop to limit the movement of the bench and for permitting a user to selectively stand and step and be seated and lay in said open area in accordance with various exercises.

2. The device of claim 1 including a pull cord mounted to each of said wing sections generally near said central portion.

3. The device of claim 2 including a compartment in said device, and weight means in said compartment for adding weight to said device to enhance the stability of said device.

4. The device of claim 2 including a detachably mounted deck on said central portion and said wing sections for providing access to the interior of said device, and said deck having a continuous upper surface which comprises said upper surfaces of said wing sections and said central portion.

5. The device of claim 4 including a tensioning mechanism for adjusting the tension of said pull cords, and said tensioning mechanism being exposed upon removal of said deck.

6. The device of claim 5 including a housing having an upstanding peripheral shoulder, said deck being mounted on said shoulder, said tensioning mechanism being mounted to said deck, each of said wing sections having a conically shaped opening in said deck, and said pull cords extending through said conically shaped guide openings.

7. The device of claim 5 wherein said tensioning mechanism includes a torque reel having a knob accessible from the outside of said device, and said cord being mounted on said reel.

8. The device of claim 2 wherein said cord is a elastic cord, a hook assembly in said wing section extending through an opening in said deck, and said elastic cord being detachably mounted to said assembly.

9. The device of claim 3 including a backboard mounted over said central section, said backboard having a flat support surface with a pair of ends, a mounting block secured to one of said ends in said concave area, said mounting block having a height generally equal to the height of said central section, and a stop block secured to the other of said ends and disposed over the edge of said central portion remote from said concave area.

10. The device of claim 1 wherein said device includes a plurality of said central portions with a wing section extending from each side of each central portion.

11. The device of claim 10 including a surround sound and video screen mounted to said device.

12. The device of claim 1 including a non-slip mat on said continuous aerobic exercise platform.

13. The device of claim 1 including weights in said base for increasing stability of said device.

14. The device of claim 1 wherein said continuous aerobic platform overhangs said side wall of said base.

15. The device of claim 1 wherein said side wall of said base is integral and continuous around said base at said wing sections and said central portion.

16. The device of claim 1 wherein said floor contacting surface is continuous and integral around said base at said wing sections and said central portion.

17. The device of claim 1 wherein said wing sections diverge away from each other at said open space.

18. The device of claim 17 wherein each of said wing sections is of decreasing width in a direction away from said central portion.

19. The device of claim 18 wherein each of said wing sections terminates in a free end remote from said central portion, and the maximum distance between said free ends of said wing sections being greater than the distance between said wing sections at the location where said wing sections are connected to said central portion.

20. The device of claim 1 wherein said floor contacting surface is integral with said side wall.

21. An aerobic exercise device comprising a central portion having a flat upper surface to comprise a central aerobic exercise platform, at least one wing section connected to and being offset from said central portion, said wing section having a flat upper surface to provide an auxiliary aerobic exercise platform, said upper surface of said wing section being coplanar with said upper surface of said central portion, said upper surfaces of said wing section and of said central portion forming a continuous aerobic exercise platform, said at least one wing section includes two wing sections, one of said wing sections being connected to and offset to each side of said central portion to form a generally concave area within the periphery of the connecting edge of said wing sections and said central portion, a pull cord mounted to each of said wing sections generally near said central portion, a detachably mounted deck on said central portion and said wing sections for providing access to the interior of said device, said deck having a continuous upper surface which comprises said upper surfaces of said wing sections and said central portion, a tensioning mechanism for adjusting the tension of said pull cords, said tensioning mechanism being exposed upon removal of said deck, a housing having an upstanding peripheral shoulder, said deck being mounted on said shoulder, said tensioning mechanism being mounted to said deck, each of said wing sections having a conically shaped opening in said deck, said pull cords extending through said conically shaped guide openings, said tensioning mechanism including an outer bracket and an inner bracket generally parallel to each other and secured to said deck, a shaft rotatably mounted to said outer bracket, a spring housing mounted to said inner bracket, said shaft being mounted to said spring housing, a spring in said spring housing secured to said shaft, a cord drum on said shaft, said cord being mounted on said cord drum, said spring urging said shaft in a direction for rotating said cord drum to urge its said cord in a return direction, a strap drum mounted on said shaft, a strap secured around said strap drum, said strap having a pair of ends, one of said ends of said strap being anchored, the other of said ends of said strap being mounted to a tension arm, a pawl on said tension arm, said tension arm being pivotally mounted, and a ratchet having teeth for selective engagement with said pawl in accordance with the location of said tension arm.

22. The device of claim 21 wherein said tension arm is accessible from the interior of said housing through a slot in said housing for permitting the sliding of said tension arm to adjust the tension externally of said device, and said wing sections being mirror images.

* * * * *